US008851344B2

(12) United States Patent
Baumann et al.

(10) Patent No.: US 8,851,344 B2
(45) Date of Patent: Oct. 7, 2014

(54) HOLSTER

(75) Inventors: John J. Baumann, Islip, NY (US); Gene DeSantis, Brookville, NY (US)

(73) Assignee: Gunhide Properties, LLC, Amityville, NY (US)

( * ) Notice: Subject to any disclaimer, the term of this patent is extended or adjusted under 35 U.S.C. 154(b) by 310 days.

(21) Appl. No.: 13/473,665

(22) Filed: May 17, 2012

(65) Prior Publication Data

US 2013/0306691 A1 Nov. 21, 2013

(51) Int. Cl.
*F41C 33/02* (2006.01)
*F41C 33/00* (2006.01)

(52) U.S. Cl.
USPC ..... 224/244; 224/243; 224/192; 224/193; 224/198

(58) Field of Classification Search
CPC ..... F41C 33/02; F41C 33/0263
USPC ..... 224/244, 243, 192, 193, 198, 912
See application file for complete search history.

(56) References Cited

U.S. PATENT DOCUMENTS 5,100,036 A * 3/1992 Rogers et al. ..... 224/244
5,129,562 A * 7/1992 Bianchi ..... 224/244
5,275,317 A * 1/1994 Rogers et al. ..... 224/244
5,284,281 A * 2/1994 Nichols ..... 224/244
5,810,221 A * 9/1998 Beletsky et al. ..... 224/244
5,855,305 A * 1/1999 Nichols ..... 224/244
6,230,946 B1 * 5/2001 Vor Keller et al. ..... 224/244
6,533,149 B2 * 3/2003 Vor Keller et al. ..... 224/244
6,752,300 B2 * 6/2004 Har-Shen ..... 224/244
6,948,644 B1 * 9/2005 Beletsky ..... 224/193
7,200,965 B2 * 4/2007 Vor Keller et al. ..... 42/70.11
7,290,688 B2 * 11/2007 Pikielny ..... 224/163
7,556,181 B2 * 7/2009 Spielberger ..... 224/244
8,235,263 B1 * 8/2012 Yeates et al. ..... 224/243

* cited by examiner

*Primary Examiner* — Justin Larson
*Assistant Examiner* — Lester L Vanterpool
(74) *Attorney, Agent, or Firm* — Bennet K. Langlotz; Langlotz Patent & Trademark Works, Inc.

(57) ABSTRACT

Holsters have a body defining a chamber configured to removably receive a portion of a firearm, the chamber including a trigger guard receiving portion configured to receive a trigger guard of the firearm, first and second retention latches connected to the body, each of the latches being movable between a retention position in which the firearm resists extraction from the holder and an extraction position in which the firearm is free to be extracted from the holder, each of the latches having a stop portion positioned behind a portion of the front trigger guard portion when the latch is in the retention position, and the stop portion being positioned laterally clear of the front trigger guard portion when the latches and the extraction position. Each of the latches may be spring biased to the retention position. Each of the latches may be pivotally connected to the body.

20 Claims, 8 Drawing Sheets

HOLSTER

FIELD OF THE INVENTION

The present invention relates to firearms, and more particularly to a holster that retains a firearm with two latches that must be simultaneously actuated to release the firearm.

BACKGROUND OF THE INVENTION

A handgun holster is a device used to hold or restrict the undesired movement of a handgun, most commonly in a location where it can be easily withdrawn for immediate use. Holsters are generally designed to offer protection to the handgun, secure its retention, and provide ready access to it. The need for ready access is often at odds with the need for security and protection. Choosing the right balance can be very important, especially in the case of a defensive weapon holster, where failure to access the weapon quickly or damage or loss of the weapon because of insufficient retention or protection could result in serious injury or death to the user.

Holsters are generally designed to be used with one hand, allowing the handgun to be removed and/or replaced with the same hand. To be able to return the handgun to its holster one-handed, the holster must be made from stiff material that holds its shape so that the holster won't collapse when the object is no longer inside to give it support.

Holsters are generally attached to a person's belt or waistband or clipped to another article of clothing. Some holsters, such as ankle holsters, have integrated support. Other holsters may fit inside a pocket to add stability and protection to the handgun, keeping it more reliably secure and accessible than if it were in the pocket alone.

Holster designs for firearms cover a wide range of shapes, materials, and retention/release mechanisms, from simple leather pouches hanging from a belt to highly protective holsters with flaps that cover the entire handgun, to highly adjustable competition holsters that hold the handgun at a precise position and release instantly when activated. The wide range of types indicates the highly varied circumstances in which holsters are used, and the varying preferences of the users. Duty holsters, which are typically worn by uniformed peace officers and security personnel, are designed to be carried openly, so concealment is not an issue, but retention is of high importance. Duty holsters can be made of leather (plain, basket weave, or glossy), nylon, or plastic; they are designed to be attached to a duty belt, and worn on the dominant side.

The primary characteristic that often distinguishes duty holsters from all other holster designs is retention. Modern law enforcement duty holsters are available with varying levels of retention security (i.e. Level I, Level II, Level II+, Level III, etc.; some security features are passive (such as retention screws, decoy straps, or hood guards), while others are active and require deliberate manipulation by the officer during the draw (such as traditional thumb break snaps). While a higher level of retention will make it more difficult for a suspect to snatch a holstered handgun away from an officer, it may also reduce the speed and ease with which an officer may draw his handgun (especially if the security features are active and not passive). Therefore, when selecting a duty holster, an officer or agency purchasing authority may be forced to find a suitable compromise of speed and retention. When choosing a holster for a firearm, factors of interest include:

Safety—a well-designed holster will provide protection to the handgun during insertion into or removal from the holster or while being carried that will: 1. prevent accidental trigger movement; 2. prevent accidental disengagement of the safety mechanism; 3. prevent forward or rearward movement of the hammer. These features will vary greatly as applicable to the action of the handgun. The safety features of a holster very much require that the holster be engineered and designed for each specific manufacture and model of handgun.

Retention—a holster designed with retention in mind will help prevent a gun from being removed from the holster by anyone other than the person wearing it. Modern duty holsters have multiple hidden retention devices to this end. Frequently, retentive holsters are custom designed for a specific model of gun.

Draw ease—practical shooting holsters must allow a gun to be presented quickly.

Versatility—it is preferable not to have to stock a wide range of different holster types for left and right side carry, for different barrel and slide lengths, or for field or office duty. While some range of models is needed for different gun types, it is desirable to minimize this both for economy of manufacturing and distribution, and for economy of agency purchasing and inventorying.

Therefore, a need exists for a new and improved holster that retains a firearm with two latches that must be simultaneously actuated to release the firearm. In this regard, the various embodiments of the present invention substantially fulfill at least some of these needs. In this respect, the holster according to the present invention substantially departs from the conventional concepts and designs of the prior art, and in doing so provides an apparatus primarily developed for the purpose of providing multiple retention measures for a firearm while also enabling the firearm to be presented quickly.

SUMMARY OF THE INVENTION

The present invention provides an improved holster, and overcomes the above-mentioned disadvantages and drawbacks of the prior art. As such, the general purpose of the present invention, which will be described subsequently in greater detail, is to provide an improved holster that has all the advantages of the prior art mentioned above.

To attain this, the preferred embodiment of the present invention essentially comprises a body defining a chamber configured to removably receive a portion of a firearm, the chamber including a trigger guard receiving portion configured to receive a trigger guard of the firearm, first and second retention latches connected to the body, each of the latches being movable between a retention position in which the firearm resists extraction from the holder and an extraction position in which the firearm is free to be extracted from the holder, each of the latches having a stop portion positioned behind a portion of the front trigger guard portion when the latch is in the retention position, and the stop portion being positioned laterally clear of the front trigger guard portion when the latches and the extraction position. Each of the latches may be spring biased to the retention position. Each of the latches may be pivotally connected to the body. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
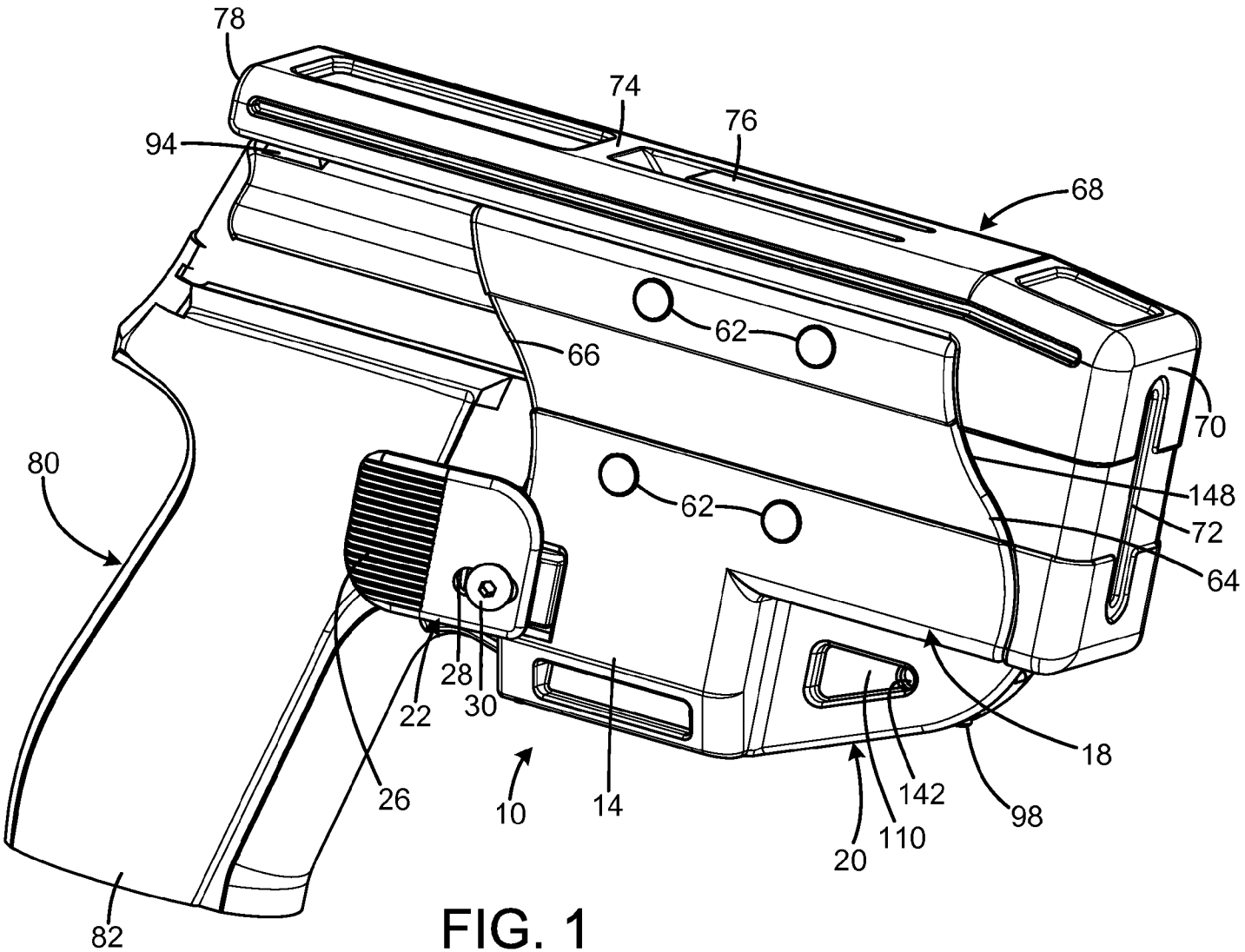
FIG. 1 is a front isometric view of the current embodiment of the holster constructed in accordance with the principles of the present invention.

An embodiment of the holster of the present invention is shown and generally designated by the reference numeral 10.

Figure 2:
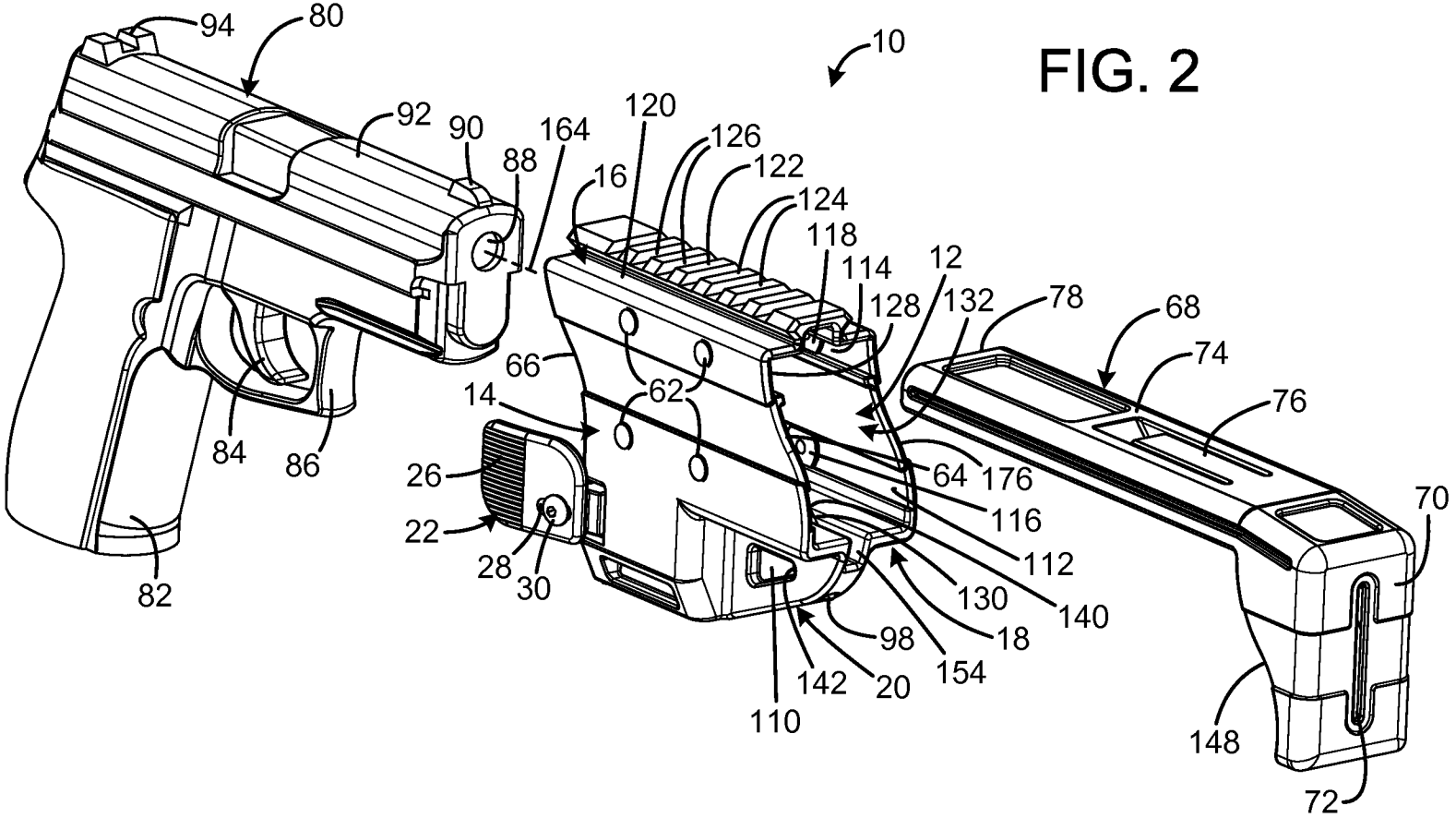
FIG. 2 is a front isometric exploded view of the current embodiment of the holster constructed in accordance with the principles of the present invention.

FIGS. 1 and 2 illustrate the improved holster 10 of the present invention with an optional muzzle hood 68 attached. More particularly, the holster 10 is depicted receiving a handgun 80 with a slide 92 of standard length. In the current embodiment, the handgun is a P229® pistol manufactured by SIG SAUER® of Exeter, N.H. However, as will be discussed in the description of FIG. 8, the position of the muzzle hood is adjustable to accommodate handguns with longer slides. The handgun has a grip 82, a trigger guard 86 encircling a trigger 84, a muzzle 88 that defines a barrel axis 164, a front sight 90, and a rear sight 94.

The holster 10 forms a generally rectangular tubular passage 132 defined by a left panel 12, right panel 14, top panel 16, and bottom panel 18. The top 120 of the top panel forms a rail 122. The rail has a plurality of teeth 124 that define slots 126. The bottom panel defines a channel 154 that receives a tension spring 130.

A front support 20 extends downward from the bottom panel 18. The front support has a solid and integral recessed body 110 and defines a circular aperture 102 and a circular aperture 96. The body 110 defines a small aperture 142. The small aperture can receive a lanyard to secure the holster. The aperture 102 is oriented vertically and receives an insert 104. The aperture 96 is oriented horizontally and receives an insert 100. A button head cap screw 106 is threaded through the insert 104 to secure one end of the tension spring 130. A set screw 98 inserted through the insert 100 to engage the opposite end of the tension spring 130. The tension spring exerts pressure against the handgun 80 to prevent movement, providing a first level of retention. The amount of tension is adjusted by the set screw 98.

A muzzle hood 68 has a rear 78 that slides over the top panel 16 when the hood is attached to the holster. The top 74 of the hood forms a spring arm 76 that engages one of the slots 126 to restrict longitudinal movement of the hood. The front 70 of the hood forms a drain slot 72 to prevent moisture from accumulating within the front of the hood. The hood defines a serpentine portion 148 on either side of the drain slot that can closely abut the front 64 of the right panel 14 and the front 176 of the left panel 12.

To holster the handgun 80, the muzzle 88 is inserted into the passage 132 between the rear 66 of the right panel 14 and the rear 138 of the left panel 12. The muzzle hood 68 may already be in place, or the muzzle hood 68 may be attached subsequently to the holster 10.

The holster 10 is illustrated in a configuration for being worn on the right hip. When configured for being worn on the right hip, four bores in the right panel 14 are filled by plugs 62. The plugs prevent moisture and dirt from entering the holster through the bores. Four bores in the left panel 12 (not visible) each receive a channel nut (116, 118 are visible in FIGS. 2 and 3; 134, 136 are visible in FIG. 3). The channel nuts are received in channels 112, 114 present in the interior surface of the left panel. The channels prevent the channel nuts rotating while a screw 152 (not visible) is threaded into the channel nuts. To configure the holster for being worn on the left hip, the plugs 62 are removed from the right panel bores, the channel nuts are transferred to the right panel bores and are received by the channels 128, 140 present in the interior surface of the right panel (also shown in FIG. 3), and the plugs are transferred to fill the left panel bores.

Figure 3:
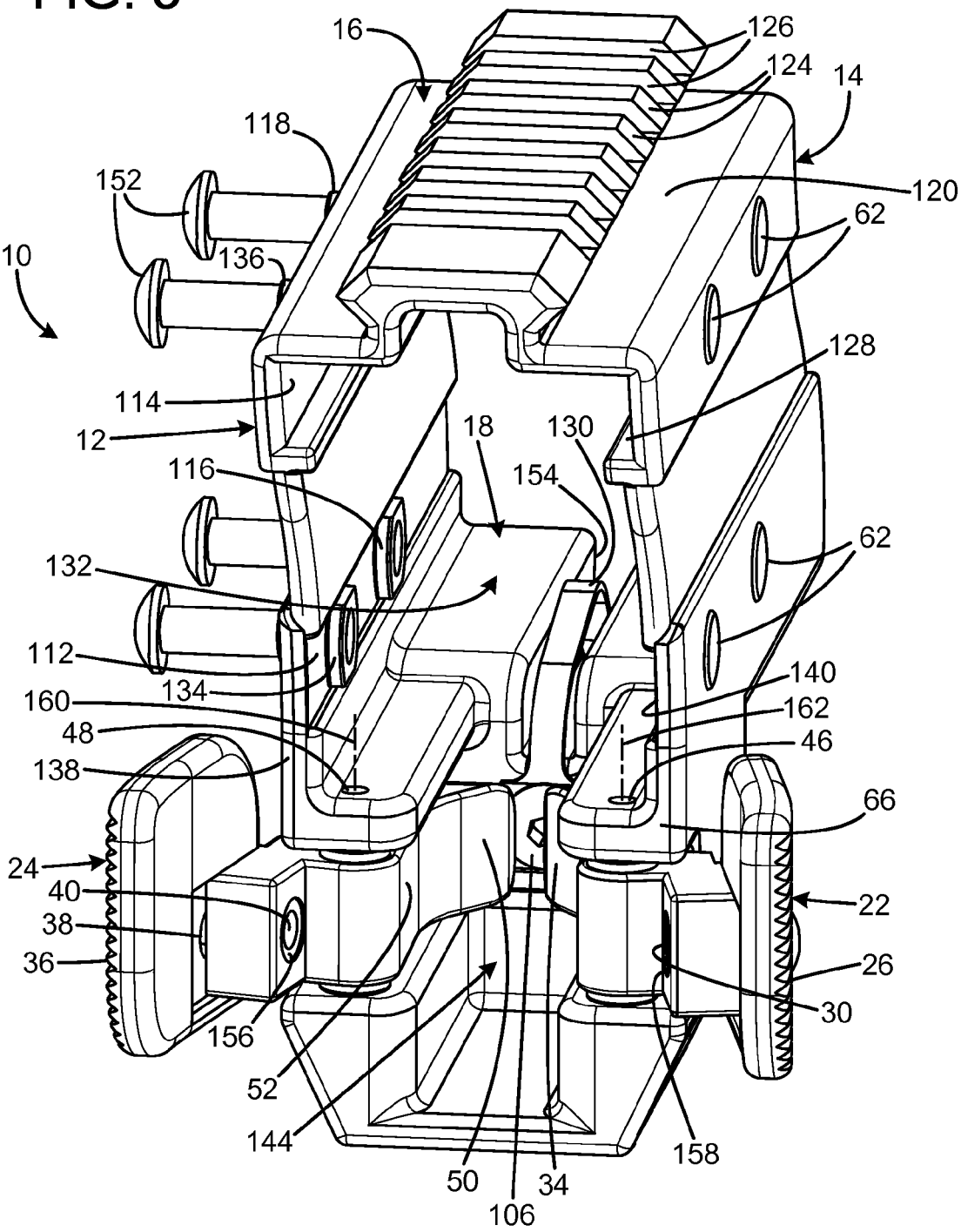
FIG. 3 is a rear isometric view of the current embodiment of the holster of the present invention with the muzzle hood and firearm removed.
Figure 4:
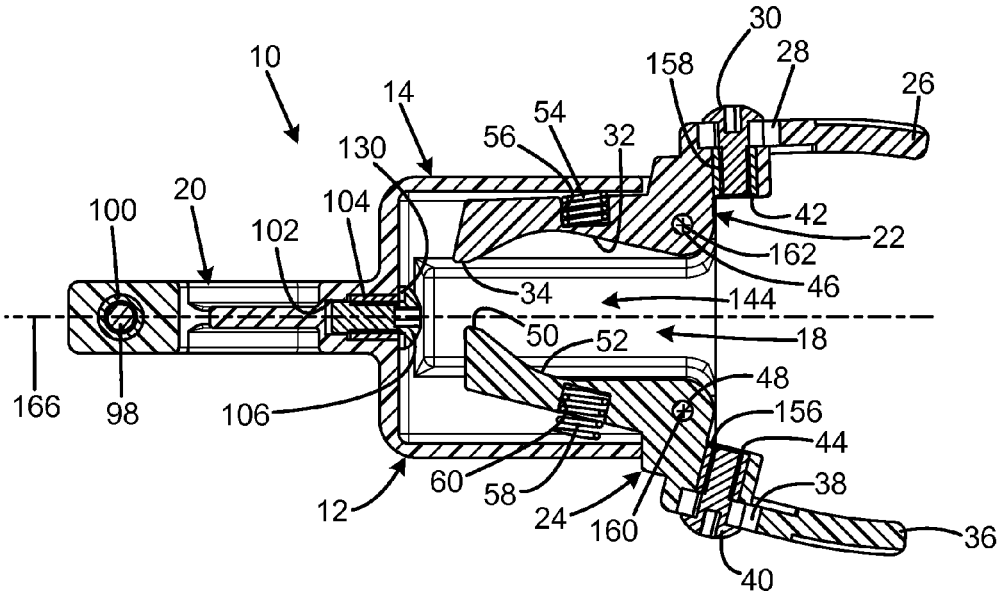
FIG. 4 is a top sectional view of the current embodiment of the holster of the present invention with the muzzle hood and firearm removed.

FIGS. 3 and 4 illustrate the improved holster 10 of the present invention with the handgun 80 and muzzle hood 68 of FIGS. 1 and 2 removed so that additional features of the holster may be appreciated. More particularly, the holster has a left latch 24 and a right latch 22 that protrude rearward from the left panel 12 and right panel 14.

The right latch has a right actuator pad 26, a right intermediate portion 32, and a right trigger guard lock 34. The right actuator pad 26 defines a slot 28 (also shown in FIGS. 1 and 2) and is attached to the right intermediate portion by a screw 30 received within a bore 42 in brass insert 158. The right intermediate portion defines a recess 56 that receives a spring 54. The right latch is pivotally secured to the right panel by a dowel pin 46 that defines a pivot axis 162. The pivot axis is parallel to the medial plane 166 that vertically bisects the holster and is perpendicular to the barrel axis 164.

The left latch has a left actuator pad 36, a left intermediate portion 52, and a left trigger guard lock 50. The left actuator pad 36 defines a slot 38 and is attached to the left intermediate portion by a screw 40 received within a bore 44 in brass insert 156. The left intermediate portion defines a recess 60 that receives a spring 58. The left latch is pivotally secured to the left panel by a dowel pin 48 that defines a pivot axis 160. The pivot axis is parallel to the medial plane 166 that vertically bisects the holster and is perpendicular to the barrel axis 164.

The screws 30, 40 in the slots 28, 38 in the right actuator pad 26 and left actuator pad 36 enable the length of the right latch 22 and left latch 24 to be adjusted to accommodate the length of the user's fingers. When the web of the users hand engages the rear of the grip 82, the right actuator pad 26 and left actuator pad 36 can be positioned precisely to facilitate an inward pinching motion between the user's thumb and index finger.

The left latch 24 is shown in the spring-biased locked position in both FIG. 3 and FIG. 4. The right latch 22 is shown in the spring-biased retention position in FIG. 3, and in the extraction position in FIG. 4. As will be further described in the discussion of FIGS. 5 and 6, the right trigger guard lock 34 and left trigger guard lock 50 provide a second and third level of retention of the handgun 80 within the holster. Only one trigger guard lock must be in the retention position to retain the handgun within the holster. A fourth level of retention is therefore provided because both the left latch and the right latch must be simultaneously depressed into the extraction position to permit the handgun to be drawn from the holster. The left intermediate portion 52 and the right intermediate portion 32 are spaced apart by a selected distance when the left latch and right latch are in the retention position to define a trigger clearance space 144.

Figure 5:
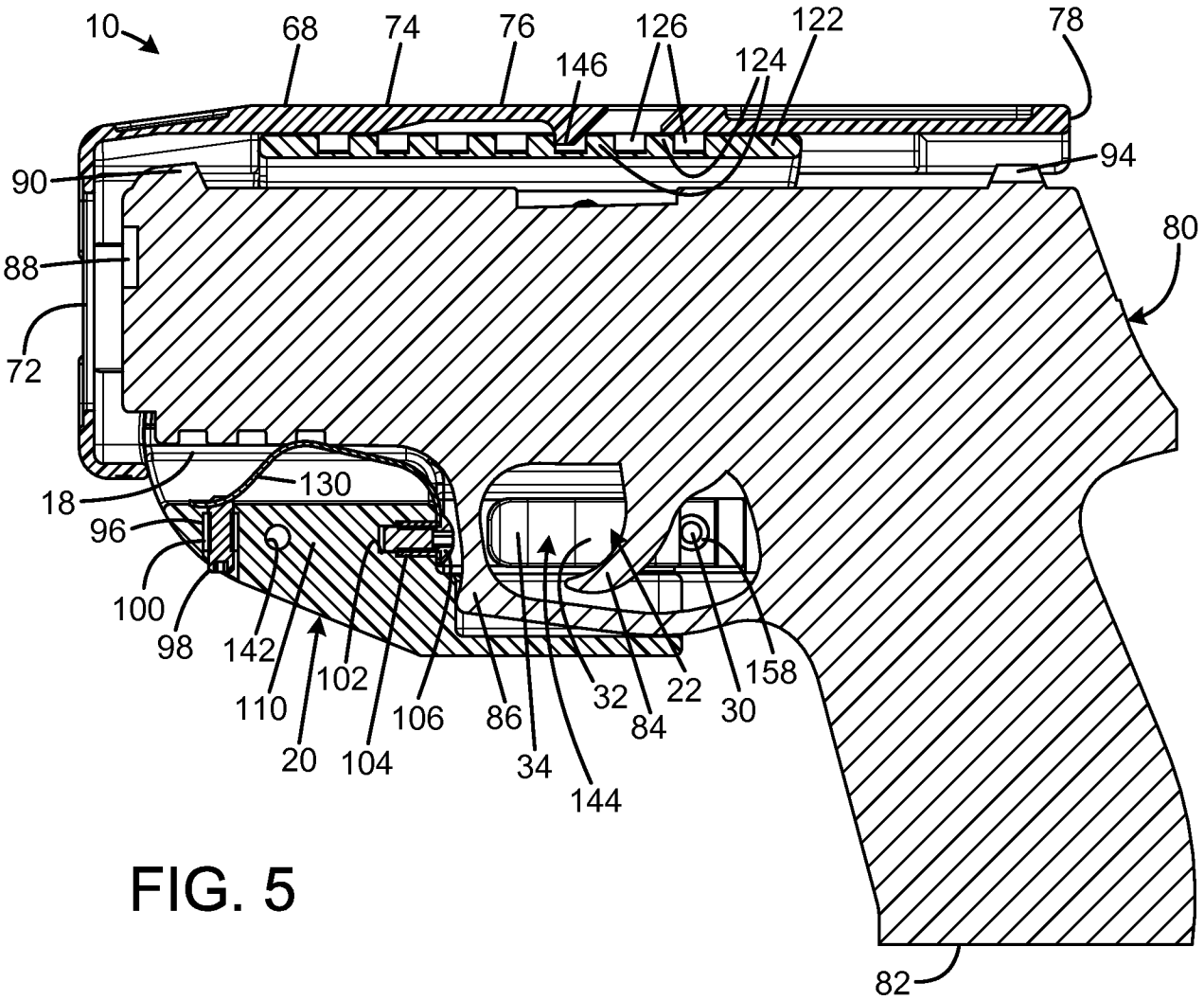
FIG. 5 is a left side sectional view of the current embodiment of the holster of FIG. 1.
Figure 6:
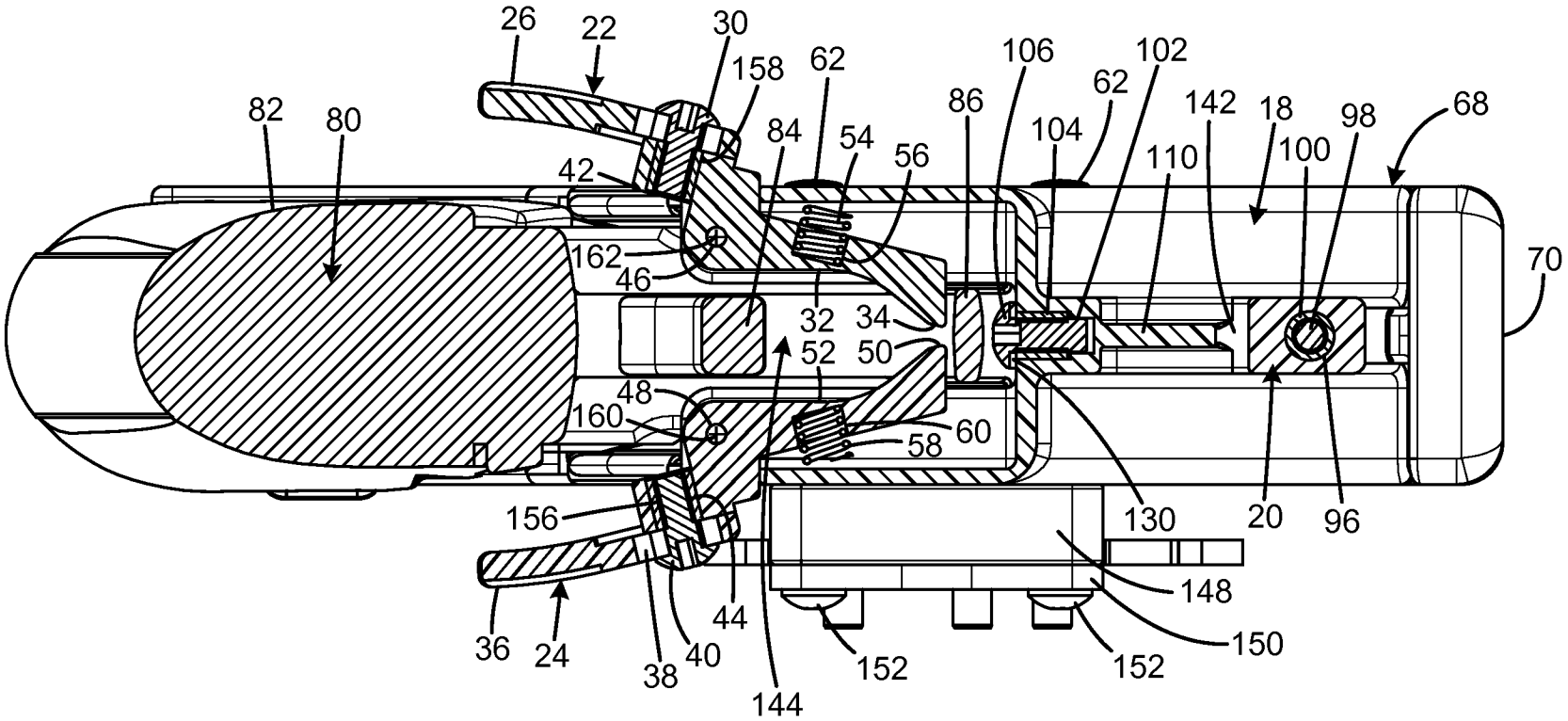
FIG. 6 is a top sectional view of the current embodiment of the holster of FIG. 1.

FIGS. 5 and 6 illustrate the improved holster 10 of the present invention with an attached muzzle hood 68. More particularly, the holster 10 is depicted receiving the handgun 80. The tension spring 130 contacts the handgun in front of the trigger guard 86 and below the muzzle 88 to prevent movement of the handgun within the holster. The right latch 22 and left latch 24 are shown in the retention position. The right trigger guard lock 34 and left trigger guard lock 50 pass between the trigger guard and the trigger 84, which prevents rearward longitudinal movement of the handgun. However, the trigger clearance space 144 between the flat elongate left intermediate portion 52 and right intermediate portion 32 ensures the trigger cannot be contacted while the handgun is holstered, and unintentional discharge of the handgun does not Occur.

The spring arm 76 on the top 74 of the muzzle hood 68 has a tooth 146 that engages one of the slots 126 in the rail 122. The rear portion of the tooth is angled so that the muzzle hood can be slid rearward with a ratcheting effect, but cannot be slid forward unless the tooth is raised and held above the teeth 124 so as to be completely disengaged from the slots. The rear 78 of the muzzle hood extends sufficiently rearward that the rear sight 94, as well as the front sight 90, are covered and protected by the muzzle hood.

Figure 7:
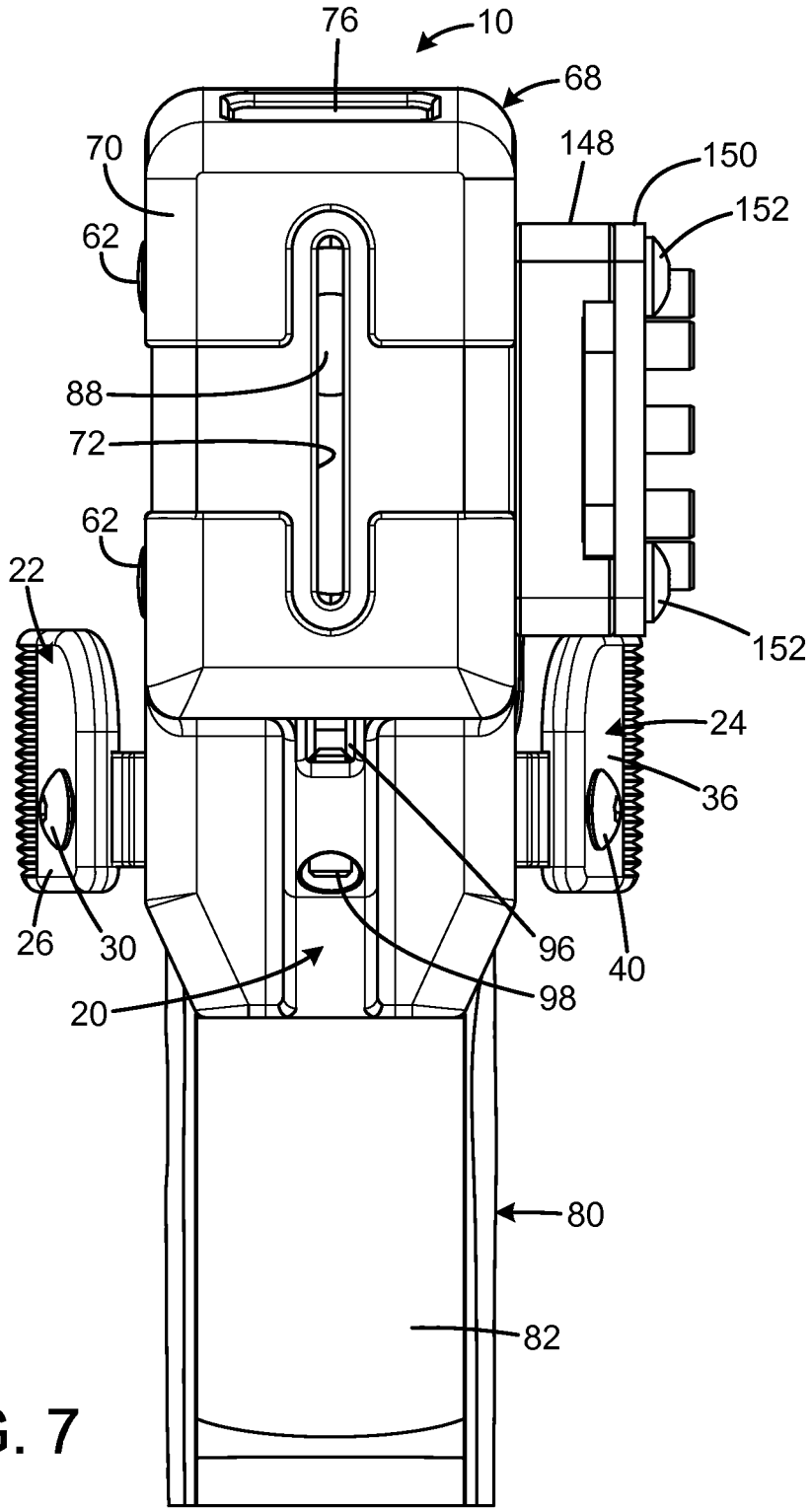
FIG. 7 is a front view of the current embodiment of the holster of FIG. 1.

FIG. 7 illustrates the improved holster 10 of the present invention with an attached muzzle hood 68. More particularly, the holster 10 is depicted receiving the handgun 80. Four screws 152 (only two are visible) are threadedly engaged with the channel nuts 116, 118, 134, 136 (not visible) to clamp a mounting adapter 148 and mounting plate 150 between them. Although the mounting adapter and mounting plate are shown attached to the holster in position for being worn on the right hip, the channel nuts can be moved to the bores in the right panel 14 to enable the mounting adapter and mounting plate to be positioned for being worn on the left hip.

Figure 8:
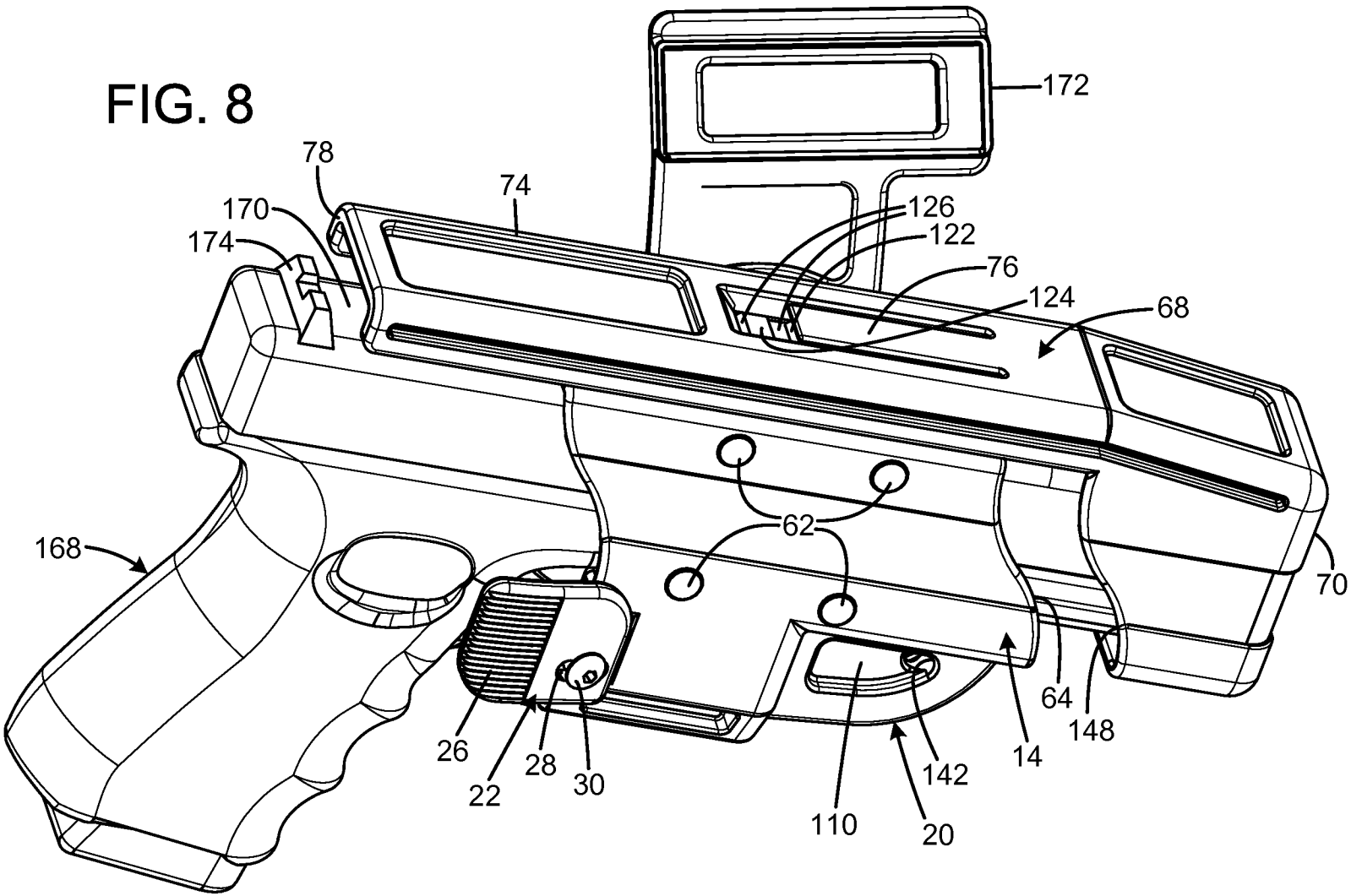
FIG. 8 is an isometric view of the current embodiment of the holster constructed in accordance with the principles of the present invention with a hip panel and a long slide handgun.

FIG. 8 illustrates the improved holster 10 of the present invention with an attached muzzle hood 68. More particularly, the holster 10 is depicted receiving a handgun 168. The handgun 168 has a longer slide 170 than the handgun 80 does. As a result, the adjustable telescoping muzzle hood 68 is positioned forward relative to the position illustrated in FIG. 1 to accommodate the longer slide. However, the combination of the spring arm 76 and rail 122 enable the muzzle hood to be securely repositioned without any modifications to the muzzle hood or holster. Alternatively, a muzzle hood with a rear extending further rearward than the illustrated muzzle hood could be substituted so the rear sight 174 of the handgun 168 would still be covered and protected by the muzzle hood. A belt frame 172 is shown attached to the mounting plate 150 (not visible) to connect the holster to the user. The belt frame is one of many alternative types of body mounting facilities, including facilities using paddles that tuck in a user's pants, clips for belts, strap assemblies for thigh holsters, shoulder holsters, and ankle holsters, and frames and shrouds for inside-the-waistband carry.

In the context of the specification, the terms "rear" and "rearward," and "front" and "forward" have the following definitions: "rear" or "rearward" means in the direction away from the muzzle of the firearm while "front" or "forward" means it is in the direction towards the muzzle of the firearm.

While a current embodiment of a holster has been described in detail, it should be apparent that modifications and variations thereto are possible, all of which fall within the true spirit and scope of the invention. For example, the rail is suitable for use to secure other accessories to the holster instead of the muzzle hood. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A holster for receiving a firearm having a trigger guard with a front trigger guard portion protecting a trigger, the holster comprising:

a body defining chamber configured to removably receive a portion of a firearm;

the chamber including a trigger guard receiving portion configured to receive a trigger guard of the firearm;

first and second retention latches connected to the body;

each of the first and second retention latches being movable between a retention position in which the firearm resists extraction from the holster, and an extraction position in which the firearm is free to be extracted from the holster if both elements are in the extraction position;

each of the first and second retention latches having a stop portion positioned adjacent a portion of the front trigger guard portion when the latch is in the retention position;

wherein the first and second retention latches are operable independently of each other such that movement of only one of the latches to the released position does not move the other latch; and the stop portion being positioned laterally clear of the front trigger guard portion when the latch is in the extraction position.

2. The holster of claim 1 further comprising each of the first and second retention latches being spring biased to the retention position.

3. The holster of claim 1 further comprising each of the first and second retention latches being pivotally connected to the body.

4. The holster of claim 1 wherein the firearm defines a medial plane and a barrel axis, and wherein the latches are operable to pivot axes that are parallel to the medial plane, and perpendicular to the barrel axis.

5. The holster of claim 1 further comprising each of the first and second retention latches having an intermediate portion, and wherein the intermediate portions are spaced apart by a selected distance when each of the latches is in the retention position to define a trigger clearance space.

6. The holster of claim 1 further comprising the body having opposed major sides, each side including an attachment facility adapted for connection to a body mounting frame, such that the user connection element may be positioned on either side for ambidextrous usage.

7. The holster of claim 1 further comprising a muzzle hood selectably connected to the body and movable among a range of positions to closely accommodate a range of firearm lengths.

8. The holster of claim 1 further comprising the first and second retention latches being positioned on opposite sides of the holster.

9. The holster of claim 1 wherein the holster defines a major medial plane, and further comprising the first and second retention latches being symmetrically located on opposite sides of the medial plane.

10. The holster of claim 8 wherein has a telescoping relation with the holster body, such that a range of slide lengths may be accommodated.

11. A holster for receiving a firearm having a trigger guard with a front trigger guard portion protecting a trigger, the holster comprising:

a body defining chamber configured to removably receive a portion of a firearm;

the chamber including a trigger guard receiving portion configured to receive a trigger guard of the firearm;

first and second retention latches connected to the body;

each of the first and second retention latches being movable between a retention position in which the firearm resists extraction from the bolster, and an extraction position in which the firearm is free to be extracted from the holster if both elements are in the extraction position;

each of the first and second retention latches having a stop portion positioned adjacent a portion of the front trigger guard portion when the latch is in the retention position;

each latch having an actuator pad adjustably connected to the latch, such that the distance from the pad to the latch stop portion is adjustable; and the stop portion being positioned laterally clear of the front trigger guard portion when the latch is in the extraction position.

12. The holster of claim 11 further comprising each of the first and seco„d „retention latches being spring biased to the retention position.

13. The holster of claim 11 further comprising each of the first and second retention latches being pivotally connected to the body.

14. The holster of claim 11 wherein the firearm defines a medial plane and a barrel axis, and wherein the latches are operable to pivot axes that are parallel to the medial plane, and perpendicular to the barrel axis.

15. The holster of claim 11 further comprising each of the first and second retention latches having an intermediate portion, and wherein the intermediate portions are spaced apart by a selected distance when each of the latches is in the retention position to define a trigger clearance space.

16. The holster of claim 11 further comprising the body having opposed major sides, each side including an attachment facility adapted for connection to a body mounting frame, such that the user connection element may be positioned on either side for ambidextrous usage.

17. The holster of claim 11 further comprising a muzzle hood selectably connected to the body and movable among a range of positions to closely accommodate a range of firearm lengths.

18. The holster of claim 11 further comprising the first and second retention latches being positioned on opposite sides of the holster.

19. The holster of claim 11 wherein the holster defines a major medial plane, and further comprising the first and second retention latches being symmetrically located on opposite sides of the medial plane.

20. A holster for receiving a firearm having a trigger guard with a front trigger guard portion protecting a trigger, the holster comprising:

a body defining chamber configured to removably receive a portion of a firearm;

the chamber including a trigger guard receiving portion configured to receive a trigger guard of the firearm;

first and second retention latches connected to the body;

each of the first and second retention latches being movable between a retention position in which the firearm resists extraction from the holster, and an extraction position in which the firearm is free to be extracted from the holster if both elements are in the extraction position;

each of the first and second retention latches having a stop portion positioned adjacent a portion of the front trigger guard portion when the latch is in the retention position;

the stop portion being positioned laterally clear of the front trigger guard portion when the latch is in the extraction position;

a shroud element operable for connection to the holster body in a plurality of positions; and wherein the holster includes an array of shroud stop elements on an upper surface, and wherein the shroud has a latch operable to engage a selected one of the stop elements.

* * * * *